United States Patent [19]

Bohlender et al.

[11] Patent Number: 5,057,672

[45] Date of Patent: Oct. 15, 1991

[54] RADIATOR HAVING PTC ELECTRIC RESISTANCE HEATING ELEMENTS AND SPRING-BIASED FIN ARRANGEMENT

[75] Inventors: Franz Bohlender, Kandel; Josef David, Bad Bergzabern, both of Fed. Rep. of Germany

[73] Assignee: Apparte und Heizwiderstande GmbH, Fed. Rep. of Germany

[21] Appl. No.: 373,906

[22] Filed: Jun. 29, 1989

[30] Foreign Application Priority Data

Jul. 15, 1988 [EP] European Pat. Off. ..... 8111419

[51] Int. Cl.[5] ..... H05B 3/02; H05B 3/14; F24H 3/04; H01C 1/084

[52] U.S. Cl. ..... 219/540; 219/202; 219/505; 219/530; 219/541; 338/22 R; 392/347; 392/360; 392/379

[58] Field of Search ..... 219/530, 540, 541, 504, 219/505, 375, 374, 202, 365; 392/360, 347, 379, 491; 338/22 R

[56] References Cited

U.S. PATENT DOCUMENTS 4,482,801 11/1984 Habata et al. ..... 219/540

FOREIGN PATENT DOCUMENTS

| | | | |
|---|---|---|---|
| 243077 | 10/1987 | European Pat. Off. | 219/202 |
| 0243800 | 10/1987 | European Pat. Off. . | |
| 2226800 | 12/1972 | Fed. Rep. of Germany . | |
| 2948593 | 6/1981 | Fed. Rep. of Germany . | |
| 3119302 | 2/1982 | Fed. Rep. of Germany . | |
| 58-39042 | 3/1983 | Japan | 219/540 |
| 62-107261 | 5/1987 | Japan | 219/375 |
| 2076270 | 11/1981 | United Kingdom | 219/540 |

*Primary Examiner*—Anthony Bartis
*Attorney, Agent, or Firm*—Darby & Darby

[57] ABSTRACT

An improved radiator suitable for use with internal combustion engines in motor vehicles is provided. The invention converts conventional radiators, which ordinarilly provide heat to passenger compartments through exchange of heat built up in the coolant, into electrically operable radiators with electric resistance heating elements, commonly PTC resistors. The PTC resistors have self, temperature-regulating properties which prevent over heating. Additionally, sheet metal strips in heat-transmitting contact with the PTC resistors and spring elements acting on the sheet metal strips provide an efficient heat transfer mechanism whereby heat from the resistors is transferred without the self-regulating resistors constantly shutting off.

10 Claims, 1 Drawing Sheet

RADIATOR HAVING PTC ELECTRIC RESISTANCE HEATING ELEMENTS AND SPRING-BIASED FIN ARRANGEMENT

DESCRIPTION

The present invention relates to a radiator comprising a planar mounting frame retaining a plurality of elongate heat-emitting elements extending parallel to one another in the plane defined by said mounting frame, each said heat-emitting element being engaged by a plurality of fins formed of a material having good heat-conducting properties and extending in substantially parallel spaced planes transversely of the length of said heat-emitting elements between the latter, or between the latter and two first bars of said mounting frame, respectively. A radiator of this type is generally known and is employed for instance as a heat exchanger in the cooling system of a water-cooled internal combustion engine, or as a heat exchanger in the heating system of the passenger compartment in a motor vehicle. In a radiator of this type, the heat-emitting elements are water or steam circulation pipes extending perpendicularly through the fins and secured thereto as by brazed connections.

In a motor vehicle it is sometimes necessary to have hot air instantly available without delay, for instance for defrosting windows or a windscreen or for preventing the formation of mist. The heating systems conventionally employed in motor vehicles cannot meet this requirement, because they use the coolant of the internal combustion engine as the heating medium, so that they are only able to emit heat after the internal combustion engine has been running for a certain time. Specifically in winter, when the necessity of defrosting the windows is most frequently encountered, the internal combustion engine requires considerable time, depending on exterior temperature, before it develops sufficient heat for the operation of the radiators employed for heating the air to be used for the window defrosting operation.

The method of heating an air flow by means of electrically energized resistance heater elements is generally known, classical examples of application being fan heaters and hair dryers. Electric heating appliances of this type suffer from the disadvantage that they can overheat and fuse when the air flow is interrupted for any reason, for instance due to failure of the fan motor or to obstruction of the air flow passage. For this reason, appliances of this type are usually provided with a thermostatic safety device, resulting in a more complicated and expensive construction. An additional failure of the thermostatic safety device may in this case result in a situation which is particularly precarious when the electric heater device cannot be observed from the outside, as in the case of a motor vehicle heater installation. A situation of this type may result in serious damage or even fire.

It is an object of the invention to propose a radiator of the type defined above, which is particularly suitable for employ in a motor vehicle window heating system while being of compact construction and capable of heating an air flow within an extremely short time.

The invention converts a radiator of the known type employed particularly in motor vehicles for the emission of coolant heat into an electrically operable radiator in which the heat-emitting elements are heated by electric resistance heating elements of the type having a positive coefficient of resistance and usually designated PTC resistors.

These PTC resistors are characterized by a low electric resistance in the cold state, this resistance increasing with rising temperature, so that the current flow through the PTC resistor is reduced as its temperature rises. The PTC resistor thus has self-regulating properties preventing overheating of the PTC resistor. The temperature capable of being attained by a PTC resistor at a given operating voltage can be determined by the selection of certain parameters during its manufacture in a manner which needs not be discussed in detail at present.

PTC resistors find wide-spread use as protection elements in appliances which are to be protected from overheating by excessively strong operating currents. The inherent properties of PTC resistors explained above should be specifically taken into account when employing such PTC resistors as heating elements as in the present case. The above discussed self-regulating properties of a PTC resistor result in the PTC resistor being unable to emit any sufficient amount of heat when the generated heat is not carried off. Care has therefore to be taken that an efficient heat transfer is established between the PTC resistor and the surrounding medium, in the present case an air flow. The provisions characterizing the invention further are directed to the solutions of this problem. It is of particular importance that the sheet metal strips contacting the PTC resistors are maintained in an effective heat-transmitting contact, preferably full surface contact with the PTC resistors. To this purpose the mounting frame encloses spring elements acting on the sheet metal strips through the intervening fins. In this respect it may be advantageous to mount the sheet metal strips in the mounting frame for limited movement therein to thereby enable the fins to effectively transmit the biasing forces to the sheet metal strips.

Although in the introduction particular reference has been made to heat exchangers in connection with internal combustion engines or motor vehicles, respectively, it is to be emphasized that radiators according to the invention are not restricted to this field of use, but also suitable for many other applications, particularly in domestic installatons, household applicances and the like.

An embodiment of the invention shall now be described with reference to the accompanying drawings, wherein.

Figure 1:
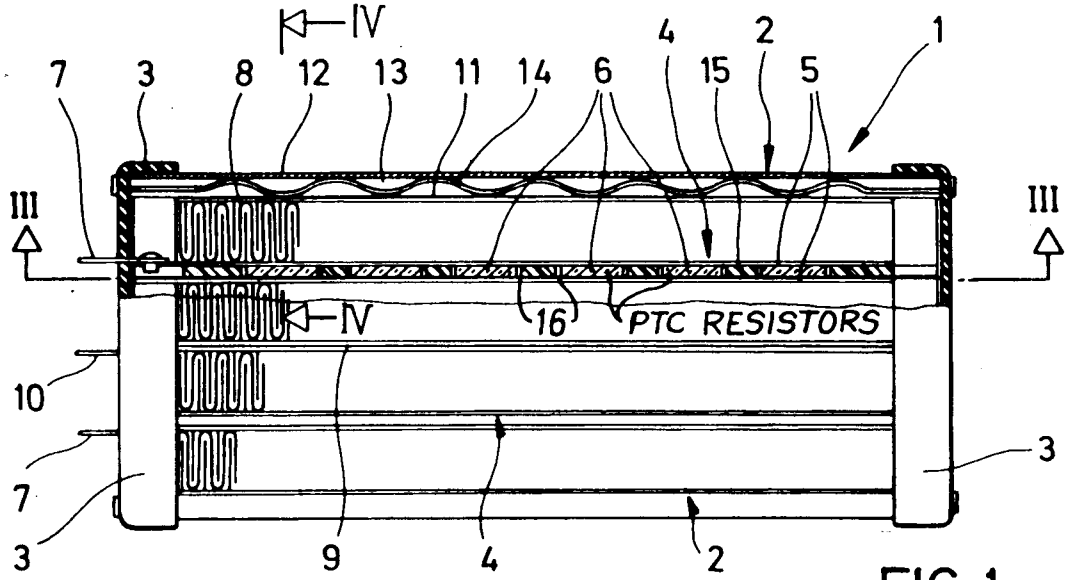
FIG. 1 shows a partially sectioned sideview taken along the line I—I in FIG. 3 of a radiator according to an embodiment of the invention.
Figure 2:
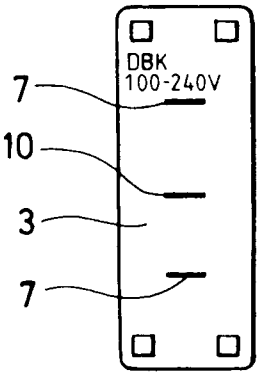
FIG. 2 shows an end view of the radiator of FIG. 1
Figure 3:
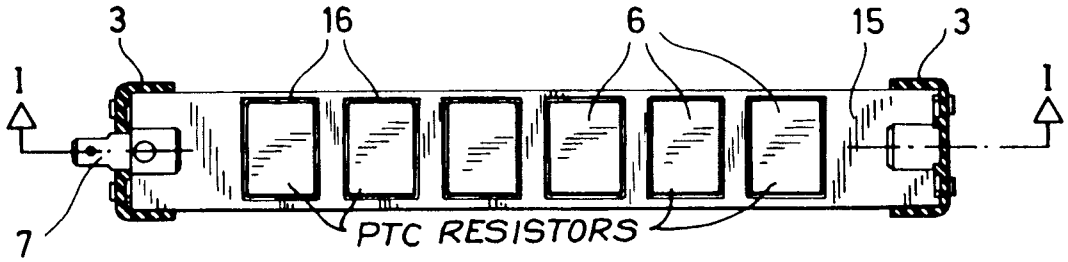
FIG. 3 shows a sectional view of the radiator of FIG. 1 taken along the line III—III in this figure.
Figure 4:
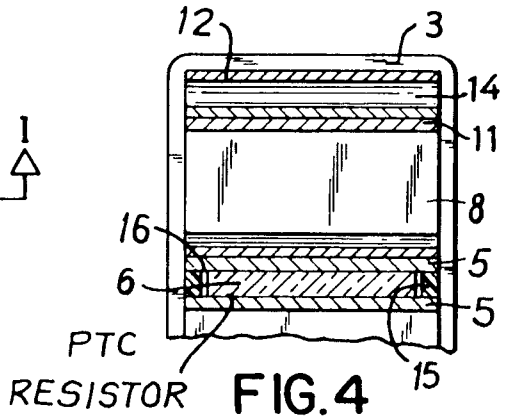
FIG. 4 shows a sectional view of the radiator taken along the line IV—IV in FIG. 1.

Shown in FIG. 1 is a sideview of a radiator, the upper part of which is depicted as a sectional view taken along the line I—I in FIG. 3. The radiator comprises a mounting frame 1 composed of longitudinally extending first frame bars 2 and transversely extending second frame bars 3 connected to one another at respective end portions to define a plane. Extending in the plane defined by mounting frame 1 and parallel to first frame bars 2 is a plurality of, in the present example, two heat-emitting elements 4, each composed of two sheet metal strips 5 extending parallel to one another so as to define a respective space therebetween for the accommodation of a plurality of PTC resistors 6 with both sides thereof contacting the adjacent sheet metal strips 5.

Sheet metal strips 5 are electrically insulated from one another and retained in second frame bars 3, at least two sheet metal strips 5 being provided with electric terminal elements, in the present case flat plug terminals 7, projecting through a respective frame bar 3. Sheet metal strips 5 are retained in second frame bar 3 so as to limit transverse movement of the length of sheet metal strips 5 in the plane defined by mounting frame 1.

The free side surfaces of sheet metal strips 5 facing away from PTC resistors 6 are abutted by the end faces of a plurality of fins 8 extending in parallel planes. The illustrated example shows four groups of fins 8, the outer end faces of fins 8 in the two outer groups adjacent first frame bars 2 being also in abutment with these frame bars, while the end faces of the fins 8 in the two inner groups are in abutment with a support sheet metal strip 9 extending between second frame bars 3 parallel to first frame bars 2 in the plane defined by mounting frame 1 and having one of its ends provided with an electric terminal, in the example shown a flat plug terminal 10. Support strip 9 is preferably likewise electrically insulated from second frame bars 3, although this is not absolutely necessary when an electric connection of mounting frame 1 to the electric power supply of the radiator is admissible.

Each of the longitudinally extending first frame bars 2 consists of an inner web 11 contacting fins 8 of the respective outer group of fins, and an outer relatively stiff rail member 12 of preferably U-shaped channel section cooperating with inner web 11 to define a cavity 13 for the accommodation of a spring element, shown here in the form of an elongate corrugated spring strip 14 supported on outer rail member 12 so as to bias inner web 11 into engagement with fins 8.

Fins 8 of each outer group of fins may have one end fixedly connected as by brazing to the respective inner web member 11 or the adjacent sheet metal strip 5, or may have both ends fixedly secured to inner web 11 and sheet metal strip 5, respectively, to thereby form an integral unit. In the same manner, fins 8 of the inner groups may be fixedly connected to support strip 9 and/or to the adjacent sheet metal strips 5.

Support strip 9 may also be eliminated, in which case the radiator comprises only three groups of fins 8, or it could be replaced by a further heat-emitting element composed of sheet metal strips and PTC resistors, in which case the radiator would contain three heat-emitting elements. It is also possible to accommodate an even greater number of heat-emitting elements in the mounting frame.

In the illustrated example, an electric voltage may be applied to flat plug terminals 7 and flat plug terminal 10 to result in a current flow from support strip 9 through fins 8 to the respective sheet metal strips 5. As an alternative, and provided the employed PTC resistors have the same characteristics, a voltage of double potential may be applied to flat plug terminals 7 to result in an electric series connection.

A strip 15 of an electrically insulating material may be employed to retain PTC resistors 6 at spaced locations between sheet metal strips 5. To this purpose, strip 15 is formed with openings 16 for the accommodation of PTC resistors 6, as shown in FIGS. 1 and 3, it being understood that the thickness of insulating strip 15 may not be greater than that of PTC resistors 6, which in the example shown are of a flat, disc-shaped configuration.

We claim:

1. A radiator comprising:

a plurality of first frame bars and a plurality of second frame bars, said plurality of first and second frame bars defining a planar mounting frame, said planar mounting frame retaining a plurality of elongate heat-emitting elements, said heat-emitting elements extending parallel to one another in the plane defined by said mounting frame, each said heat-emitting element being engaged on opposite sides by a plurality of fins formed of a material having good heat-conducting properties and extending in substantially parallel planes transversely of the length of said heat-emitting elements between two respective ones of the latter or between respective ones of the latter and two first bars of said mounting frame, respectively;

each of said heat-emitting elements comprising two sheet metal strips extending in parallel planes, and a plurality of electric PTC resistors disposed therebetween at spaced locations in surface contact with, and electrically connected to, said sheet metal strips;

said plurality of fins each having ends which are adjacent heat-emitting elements or one heat-emitting element and one of said first frame bars of said mounting frame, or one heat-emitting element and a support strip, said support strip disposed between adjacent heat-emitting elements;

each of said first frame bars comprising a rigid outer rail member extending parallel to an inner web movable relative thereto, said inner web contacting the ends of the adjacent fins, and a spring means disposed between said outer rail member and said inner web and supported on said outer rail member for biasing said inner web into engagement with said ends of adjacent fins; and said sheet metal strips being electrically insulated from one another, said strips having their ends electrically insulatively retained in said second frame bars of said mounting frame extending perpendicular thereto, at least one end of at least some of said sheet metal strips being provided with a respective electric terminal element for connecting said PTC resistors to a power supply.

2. The radiator of claim 1, wherein said sheet metal strips are retained in said second frame bars of said mounting frame for limited movement transversely of the length of said metal sheet strips in the plane defined by said mounting frame.

3. The radiator of claim 2, wherein each of said spring means consists of an elongated, corrugated spring strip; and said PTC resistors are retained at space locations between said sheet metal strips by a strip formed of an electrically insulating material and provided with openings for receiving said PTC resistors therein, the thickness of said insulating strip being not greater than that of said resistor elements.

4. The radiator of claim 2, wherein said parallel extending fins are fixedly connected to one another adjacent at least one of their ends.

5. The radiator of claim 4, wherein said fins are fixedly connected at least to a respective one of said sheet metal strips with which they are in abutment.

6. The radiator of claim 5, wherein said fins are rigidly connected to a respective one of said inner webs.

7. The radiator of claim 5, wherein said fins are fixedly connected to said support strip.

8. The radiator of claim 7, wherein said second frame bars of said mounting frame are made of an electrically insulating material.

9. The radiator of claim 8, wherein each of said spring means consists of an elongated, corrugated spring strip.

10. The radiator of claim 9, wherein said PTC resistors are retained at spaced locations between said sheet metal strips by a strip formed of an electrically insulating material and provided with openings for receiving said PTC resistors therein, the thickness of said insulating strip being not greater than that of said PTC resistors.

* * * * *